United States Patent [19]

Panagiotou

[11] Patent Number: 4,800,475

[45] Date of Patent: Jan. 24, 1989

[54] PORTABLE ELECTRIC LIGHT

[75] Inventor: George N. Panagiotou, Encino, Calif.

[73] Assignee: Cool Lux Lighting Industries, Inc., North Hollywood, Calif.

[21] Appl. No.: 113,715

[22] Filed: Oct. 27, 1987

[51] Int. Cl.[4] ..... F21V 29/00

[52] U.S. Cl. ..... 362/294; 362/373

[58] Field of Search ..... 362/294, 373

[56] References Cited

U.S. PATENT DOCUMENTS

| | | | |
|---|---|---|---|
| 2,080,120 | 5/1937 | Everett | 362/294 |
| 3,126,785 | 3/1964 | Zillmen | 362/294 |
| 3,140,053 | 7/1964 | Lowell | 362/294 |
| 3,461,282 | 8/1969 | Martinez | 362/294 |
| 3,541,492 | 11/1970 | Fenn | 362/294 |
| 3,593,019 | 7/1971 | Martinez | 362/294 |
| 3,639,751 | 2/1972 | Pichel | 362/294 |
| 3,689,761 | 9/1972 | Rosen et al. | 362/294 |
| 3,936,686 | 2/1976 | Moore | 362/294 |
| 4,692,844 | 9/1987 | Galerne | 362/373 |
| 4,703,404 | 10/1987 | Helton, III et al. | 362/294 |

*Primary Examiner*—Michael Koczo
*Assistant Examiner*—Sue Hagarman
*Attorney, Agent, or Firm*—Kenneth J. Hovet

[57] ABSTRACT

A portable high energy light having a U-shaped housing and vented cover. The housing has a front section containing light treatment parts and a back section containing a bulb assembly. The front section is cooled by an elongated slot directing ambient air between the light treatment parts and bulb assembly. The back section is cooled by an enlarged opening in the housing bottom wall located directly below the bulb assembly. A guard flange extending into the opening helps guide ambient air directly past heat generating portions of the bulb assembly.

20 Claims, 2 Drawing Sheets

PORTABLE ELECTRIC LIGHT

BACKGROUND OF THE INVENTION

1. Field of the Invention

The present invention relates to electrical lighting fixtures and, more particularly, to a portable high wattage lighting device.

2. Description of the Prior Art

Heretofore, it has been technically difficult to combine the use of a high wattage bulb with a small-scale lighting fixture. Generally, problems inherent in dissipating heat emanating from bulbs capable of producing light of an intensity comparable to that used for photographic or stage lighting have drastically limited the wattage level allowable in smaller fixtures.

A significant advancement was made in the lighting device described in U.S. Pat. No. 4,703,404. This device comprised a housing enclosed by oppositely hinged vented covers. The covers were louvered as was the entire bottom of the housing. Although significant cooling was achieved, the large number of louvers was unnecessary, costly to fabricate and actually interferred with the addition of desirable ancillary parts.

SUMMARY OF THE INVENTION

The present invention provides a high energy portable lighting device that is more efficiently cooled than the prior art. It also is more adaptable to the use of light treatment means such as lens, shades, filters and diffusers.

A U-shaped housing is provided having opposing side walls connected by a vented bottom wall and a back wall. The housing has a front section containing light treatment means and a back section containing a bulb assembly. The back section includes a vented cover and the front section may include an overlying protective cover.

The bottom wall is provided with an enlarged cooling air opening beneath the bulb assembly. A guard flange is disposed in a cooperating relationship with the enlarged opening to assist in guiding the cooling air directly onto the bulb assembly. In a similar fashion, an elongated slot is located in the bottom wall beneath the light treatment means for maximum cooling effect.

DESCRIPTION OF THE PREFERRED EMBODIMENTS

Figure 1:
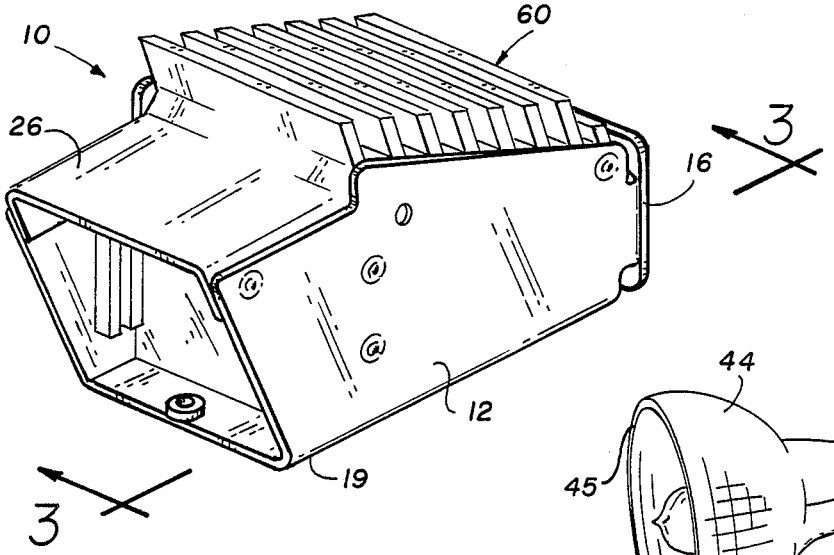
FIG. 1 is a perspective view of the portable electric light of the present invention.

With reference now to the drawings, the improved lighting device of the invention is shown generally by reference 10. The device comprises a U-shaped housing having an open top and an open front end 15. The housing includes opposing sidewalls 12,12 which are connected by a bottom wall 14. The back end of the housing is closed by a back wall 16.

The housing includes a front section 18 containing a light treatment means 20. The light treatment means includes engagement means for releasably positioning selected light treatment members within the housing.

As shown, the engagement means comprises mounting pads 22 secured to opposing sidewalls adjacent front opening 15. The pads are provided with vertical grooves 23 for disposing filter plate 24 in proper alignment. Other light treatment members, such as lens, shades, diffusers and polarizers may also be used alone or in combination. It is expected that the mounting pads can be adapted to releasably engage whatever edge structure the selected light treatment member might have.

To protect the light treatment means and to help direct light out of open end 15, it is desirable to overlie the front section with a protective cover. This may simply be an integral portion of a singular open top cover or a separate entity shown as cover 26 hinged at upper front corners 27.

The housing includes a back section 30 containing a bulb assembly 32. The assembly includes a base frame 34 having a forward portion 36 that is secured by fasteners 37 to bottom wall 14. The forward portion also includes an upstanding aperture plate 38 that extends across the housing proximate the housing midpoint. It separates the housing front section from the back section and includes a central aperture 39.

The base frame further includes a support portion 41 that projects rearwardly from the forward portion and inclines upwardly from the bottom wall. A bulb unit 42 is mounted on the support portion. The unit includes a bulb 44 with face 45 adjacent the aperture plate central aperture 39. The bulb is provided with contacts 46 for engagement with an electrical connector assembly 47 known in the art. The connector assembly includes power cord 48 which communicates with an electric power source (not shown).

Figure 2:
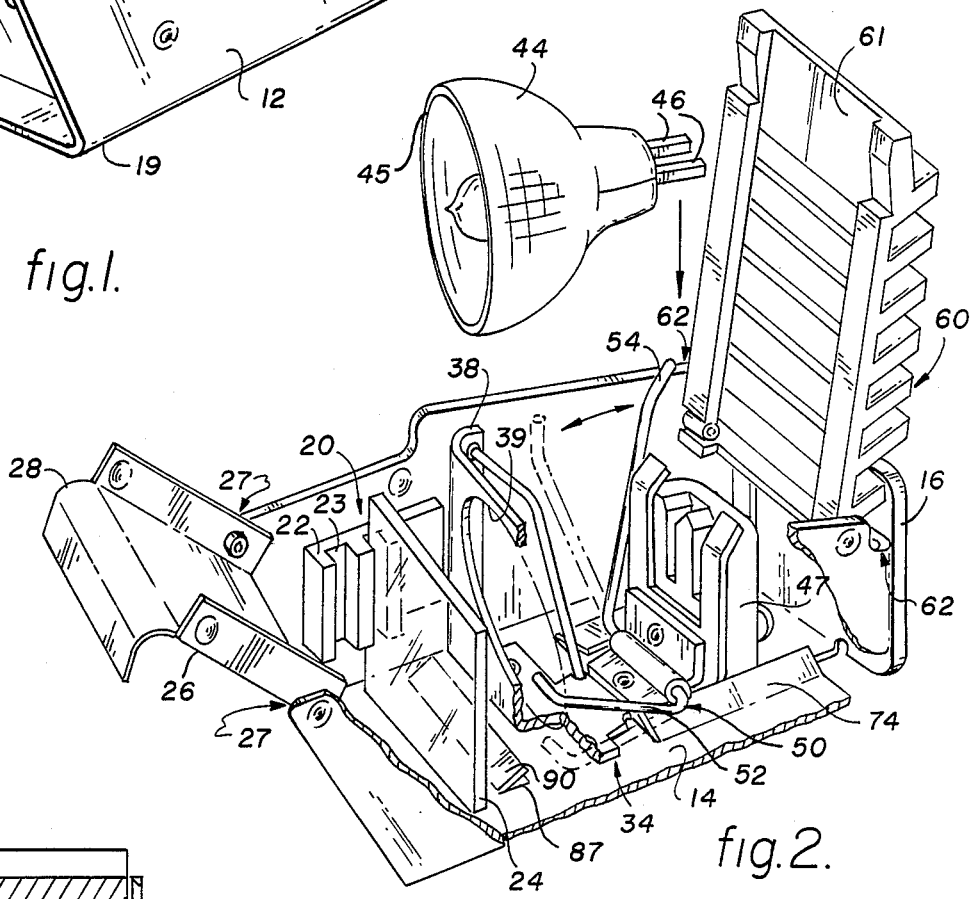
FIG. 2 is an enlaraged perspective view partially broken-away of the device of FIG. 1 in an open position with the bulb removed.
Figure 4:
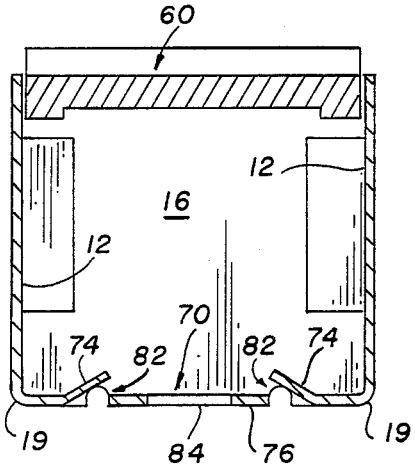
FIG. 4 is a cross-sectional view taken along lines 4—4 of FIG. 3.
Figure 5:
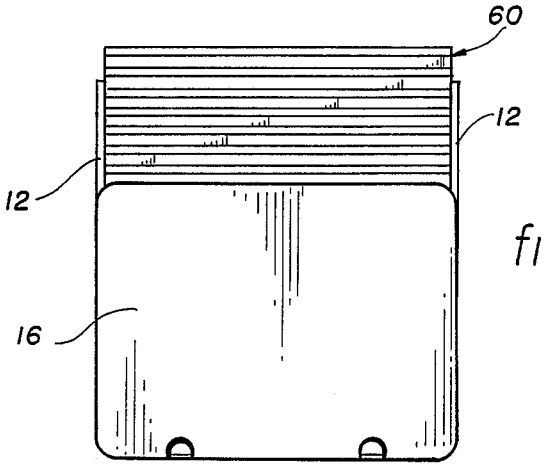
FIG. 5 is a back end view of the device shown in FIG. 1.
Figure 3:
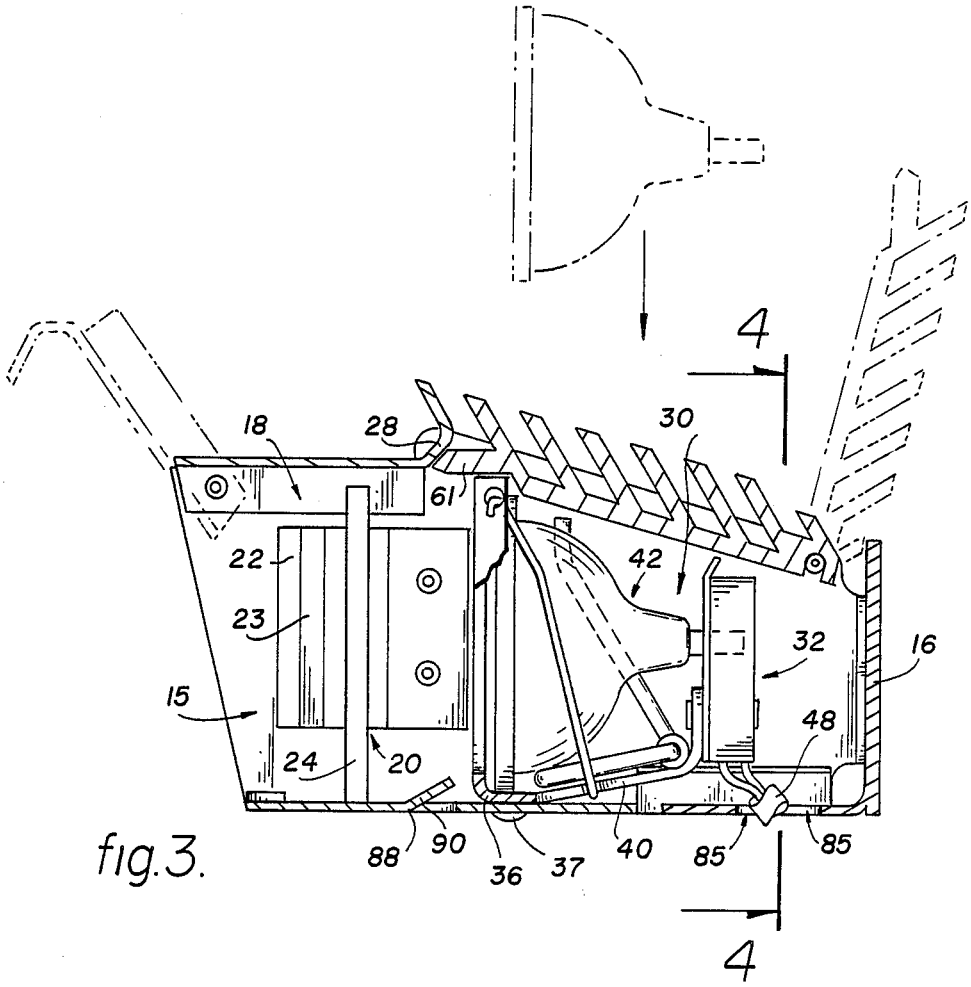
FIG. 3 is a cross-sectional view taken along lines 3—3 of FIG. 1.
Figure 6:
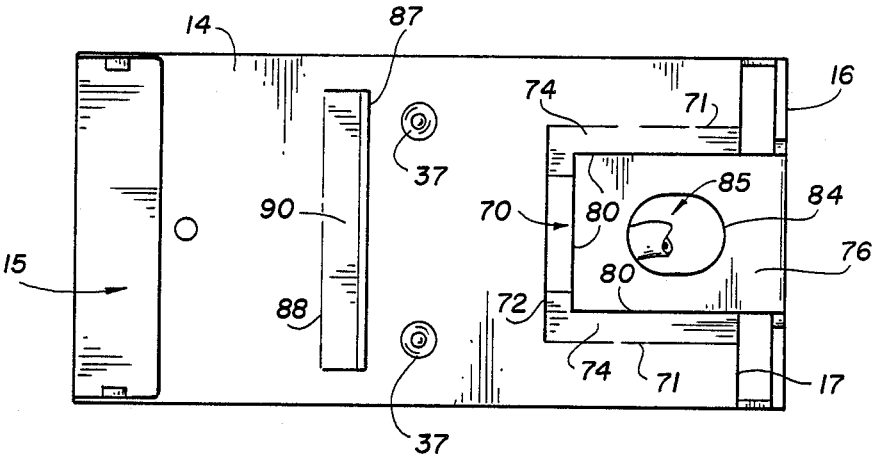
FIG. 6 is a bottom plan view of the device shown in FIG. 1.

The bulb unit may further include an ejector means comprising an angulated arm 50 pivoted to the base frame support portion. The arm includes a lower portion 52 underlying bulb 44 and an actuating portion 54 for manual reciprocation. Rearward movement of the actuating portion, as shown by arrow A in FIG. 2, will lift lower portion 52 against the bulb underside and lift the bulb from engagement with connector assembly 47.

Overlying at least the back section is a cover means shown as vent cover 60. The vent cover is hinged to upper back corners 62 of the housing sidewalls and may incorporate the above-described protective cover in one elongated unit as shown in FIG. 1. In such case, the overlapping free ends 28,61 of each respective cover would be joined and the protective cover corner hinges would be replaced with releasable engagement parts. The hinge connections could also be reversed so that the combined cover would rotate about the protective cover hinges.

An important feature of the invention is the guidance of cooling air through the housing back section. This section encloses the high wattage bulb and electrical parts that generate significant heat energy. Although such heat will rise by convection and flow out the vents in cover 60, it is highly desirable to enhance and facilitate ambient air flow through the housing. The aforementioned prior art U.S. Pat. No. 4,703,404 addressed this issue by providing vents across most of the housing bottom wall. With too many openings, however, less air was drawn past the bulb and connector assembly where it was needed most.

To overcome the above problem, bottom wall 14 includes an enlarged opening 70 coextensive with the housing back section. The opening is preferably symmetrical with the housing median plane and comprises at least one fourth of the bottom wall area corresponding to the back section. Preferably, it comprises a cut-out portion of bottom wall back edge 17 and extends inwardly beneath at least a part of the bulb assembly. It includes opposing side edges 71 which are connected by an end edge 72. As shown, the side edges are adjacent the housing lateral edges 19 and a quadrilateral-shaped opening is defined. The side edges may include air deflectors 74 which incline upwardly and inwardly toward each other.

Extending into the enlarged opening is guard flange 76. The guard flange may be tabularly supported by the bottom wall or extend from back wall 16. As shown, it comprises an inwardly directed extension of bottom edge 77 of the back wall. It is preferably coextensive and symmetrical with enlarged opening 70. It includes peripheral edges 80 which are spaced-apart from at least side edges 71. As so disposed, discrete air passages 82 are created in the spacing between respective edges allowing for controlled air flow directly past the bulb assembly heat sources.

To further enhance directed air flow, the guard flange is provided with a central vent orifice 84. The vent orifice provides an outlet for power cord 48 with the remaining annular area 85 permitting additional air flow directly adjacent the electrical connector assembly.

The housing front section is provided with directed air flow by elongated slot 87. The slot extends across a major portion of the bottom wall width between the bulb assembly and light treatment means. In particular, it is disposed forward of bulb 44 and guides cooling air directly across bulb face 45. An air guide 90 which inclines upwardly and rearwardly from outer slot edge 88 may be used to positively wash the bulb face with a continuous flow of ambient air. The bulb face is a significant heat source and the directed air flow increases bulb life and avoids heat distortion and damage to any of the light treatment members.

While the invention has been described with respect to preferred embodiments, it will be apparent to those skilled in the art that various modifications and improvements may be made without departing from the scope and spirit of the invention. Accordingly, it is to be understood that the invention is not to be limited by the specific illustrative embodiments, but only by the scope of the appended claims.

I claim:

1. In a portable lighting device having a bulb assembly mounted within a housing defined by a bottom wall with opposing sidewalls and a back wall extending across said sidewalls, said housing having an open front end and an open top overlaid by a cover means, wherein the improvement comprises:

an enlarged opening in said bottom wall beneath said bulb assembly covering at least one fourth of the area of said bottom wall which is beneath said bulb assembly, said opening having opposing side edges;

a guard flange extending into said opening having peripheral edges spaced-apart from said side edges to define passages for air flow to said bulb assembly;

an elongated slot in said bottom wall offset from said front end; and, said cover means including a vent cover having air vent openings located at least above said enlarged opening and elongated slot.

2. The device of claim 1 including light treatment means positioned in said housing forward of the bulb assembly and adjacent said elongated slot.

3. The device of claim 2 wherein said light treatment means includes engagement means for a member selected from the group consisting of lens, shades, light filter, light difusser and light polarizer.

4. The device of claim 2 wherein said cover means includes a protective cover located above said light treatment means.

5. The device of claim 1 wherein said bottom wall has a back edge and said enlarged opening extends from said back edge.

6. The device of claim 5 wherein said guard flange extends from said back wall into said enlarged opening.

7. The device of claim 6 wherein said guard flange is coextensive with said enlarged opening.

8. The device of claim 1 wherein said opposing side edges include upwardly inclined air deflectors.

9. The device of claim 1 wherein said guard flange is provided with a vent orifice.

10. The device of claim 1 wherein said elongated slot includes an upwardly inclined air guide.

11. In a portable lighting device having a housing with a front section containing a light treatment means and a back section containing a bulb assembly wherein said housing includes a bottom wall having an enlarged opening in said back section and an elongated slot in said front section with a vented cover overlying at least said back section, said enlarged opening covering at least one fourth of the area of said bottom wall corresponding to said back section, said opening having opposing side edges; and, a guard flange extending into said opening having peripheral edges spaced-apart from said side edges to define passages for air flow to said back section.

12. The device of claim 11 including a protective cover overlying said front section.

13. The device of claim 11 wherein said bottom wall includes a back edge and said enlarged opening comprises a cut-out portion of said back edge extending inwardly beneath said bulb assembly.

14. The device of claim 13 wherein said housing includes a back wall and said guard flange extends from said back wall into said enlarged opening.

15. The device of claim 13 wherein said side edges include upwardly inclined air deflectors.

16. The device of claim 14 wherein said guard flange is coextensive with said enlarged opening.

17. The device of claim 11 wherein said light treatment means includes a light treatment member and an engagement means for releasably connecting said member to said housing.

18. The device of claim 17 wherein said light treatment member is selected from the group consisting of lens, shade, light filter, light diffuser and light polarizer.

19. The device of claim 18 wherein said elongated slot extends across said bottom wall between said bulb assembly and said light treatment member.

20. The device of claim 16 wherein said guard flange extends from the bottom of said back wall and includes a vent orifice.

* * * * *